US007703260B1

(12) United States Patent
Watkins

(10) Patent No.: US 7,703,260 B1
(45) Date of Patent: Apr. 27, 2010

(54) CIRCULAR MOTION CASE PACKING SYSTEM

(76) Inventor: Norman M. Watkins, 102 Leesburg Peak, Greer, SC (US) 29651

( * ) Notice: Subject to any disclaimer, the term of this patent is extended or adjusted under 35 U.S.C. 154(b) by 285 days.

(21) Appl. No.: 11/818,835

(22) Filed: Jun. 15, 2007

Related U.S. Application Data

(60) Provisional application No. 60/813,837, filed on Jun. 15, 2006.

(51) Int. Cl.
*B65B 1/04* (2006.01)

(52) U.S. Cl. ..... 53/250; 53/534

(58) Field of Classification Search ..... 53/244, 53/247, 250, 251, 253, 254, 272, 467, 473, 53/475, 534, 539, 543
See application file for complete search history.

(56) References Cited

U.S. PATENT DOCUMENTS

| | | | | |
|---|---|---|---|---|
| 3,327,450 | A | 6/1967 | Carter | |
| 3,505,787 | A | 4/1970 | Tiews | |
| 3,553,932 | A | 1/1971 | Rowekamp | |
| 3,780,492 | A | 12/1973 | Corderoy | |
| 3,991,539 | A * | 11/1976 | Luca | 53/448 |
| 4,302,919 | A | 12/1981 | Hartness | |
| 5,212,930 | A | 5/1993 | Raudat | |
| 5,487,257 | A | 1/1996 | Domeier et al. | |
| 5,588,282 | A * | 12/1996 | Hartness | 53/473 |
| 5,797,249 | A * | 8/1998 | Hartness | 53/473 |
| 6,612,095 | B2 | 9/2003 | Hartness | |
| 6,729,103 | B1 * | 5/2004 | Hartness et al. | 53/247 |
| 6,748,725 | B2 | 6/2004 | Hartness et al. | |
| 6,983,577 | B2 * | 1/2006 | Hartness et al. | 53/471 |
| 6,993,884 | B2 | 2/2006 | Baranowski | |
| 7,392,630 | B2 * | 7/2008 | Ford | 53/48.1 |
| 2003/0009994 | A1 * | 1/2003 | Hartness et al. | 53/473 |
| 2003/0106288 | A1 * | 6/2003 | Hartness et al. | 53/473 |
| 2004/0003574 | A1 * | 1/2004 | Hartness et al. | 53/247 |
| 2004/0068956 | A1 * | 4/2004 | Hartness et al. | 53/247 |
| 2006/0017298 | A1 | 1/2006 | Osten et al. | |

* cited by examiner

*Primary Examiner*—Hemant M Desai
(74) *Attorney, Agent, or Firm*—Sara A. Kanos; Michael A. Mann; Nexsen Pruet, LLC

(57) ABSTRACT

An apparatus, system and method in which containers are packed with articles for shipping, handling, and storage purposes. The apparatus includes a rotating disc having arms, which carry packing heads. A conveyor system provides articles and empty containers for packing. The method is further described as being of an un-interrupted nature and therefore the apparatus and method will be referred to as a continuous motion case packing machine.

22 Claims, 9 Drawing Sheets

CIRCULAR MOTION CASE PACKING SYSTEM

CROSS REFERENCE TO RELATED APPLICATIONS

The present invention claims the benefit of priority of U.S. Provisional Application No. 60/813,837, filed Jun. 15, 2006.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not Applicable.

BACKGROUND OF INVENTION

The present invention relates generally to circular motion machines, and, in particular, to a method and apparatus for packing containers.

Circular packing machines are known. These are typically either intermittent or continuous in motion. With intermittent packing machines, heads connected to a turret are typically moved vertically, rotated, and stopped at particular locations so that objects can be lifted and then placed into containers. With continuous packing machines, mechanical packing heads revolve continuously to pick up objects and pack the containers. Each of these types of devices has both advantages and disadvantages. Generally, intermittent-type packing machines lack the convenience and efficiency of continuous-type machines. However, additional costs and manufacturing complications are associated with continuous packing machines.

Accordingly, there exists a need for an improved device that draws from the ideal features of these known devices.

SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. Its sole purpose is to present some concepts of the invention in a simplified form as a prelude to the more detailed description that is presented later.

The present invention includes an apparatus, system and method in which containers are packed with articles for shipping, handling, and storage purposes. The method is further described as being of an un-interrupted nature and therefore the apparatus and method will be referred to as a continuous motion case packing machine.

In particular, the apparatus of the present invention can include a disc, which is revolving around an axis at a continuous angular velocity. Multiple arms extend from the disc, which are dimensioned to carry mechanical packing heads. The arms are individually accelerating or decelerating in relative angular velocity to the disc to match the linear velocity of a separate elevated conveyor transporting articles. Once positioned above the conveyor and articles, the heads are responsible for picking up articles. Thereafter, the heads are preferably accelerated to a neutral or advanced position by the disc arms, and carry the articles along a circular but horizontal path for later packing in containers.

The apparatus also includes an escalating carrier mechanism which can transport containers on a path alternating between convergent and divergent to the path of the mechanical packing heads but below the elevation of the mechanical packing heads and the articles they carry. First, the escalating carrier is elevated to approach the elevation of the mechanical packing heads. As the containers approach the articles being carried by a single head, the angular velocity of that specific head, which was previously altered from that of the rotating disc, is independently accelerated or decelerated to match the forward velocity of the container carrier. Once the container has reached a suitable elevation and positioning below the articles by means of the escalating carrier, the articles are released by the mechanical packing head and the container and articles exit the apparatus as a packaged, product. The escalating carrier mechanism is then lowered in elevation to release the packed container onto an exit conveyor. The individual head is then accelerated back to its original relative position and the cycle can repeat.

A feature of the present invention includes the use of a plurality of independent arms carrying mechanical packing heads that can be advanced, retarded and stopped so as to simulate the continuous packing of containers. The movement of the arms can be independent of the continuously rotating disc. Accordingly, there is no need to stop and re-start the entire disc and arms each instance of retrieving and packing of articles, such as is common in more traditional intermittent-type packing machines.

Another feature of the present invention includes the use of an escalating carrier mechanism to bring containers to a suitable elevation and positioning below the rotating heads. This feature allows for a constant, horizontal motion of the heads and objects being carried by the heads. Vertical motion is therefore minimized, which can provide enhanced conservation of energy and lower costs, especially if the objects being carried by the mechanical packing heads have a greater weight than the empty containers being elevated.

These features and other advantages of the present invention will be apparent to those skilled in the art from a careful reading of the Detailed Disclosure of the Invention presented below and accompanied by the drawings.

DETAILED DISCLOSURE OF THE PREFERRED EMBODIMENTS

Figure 1:
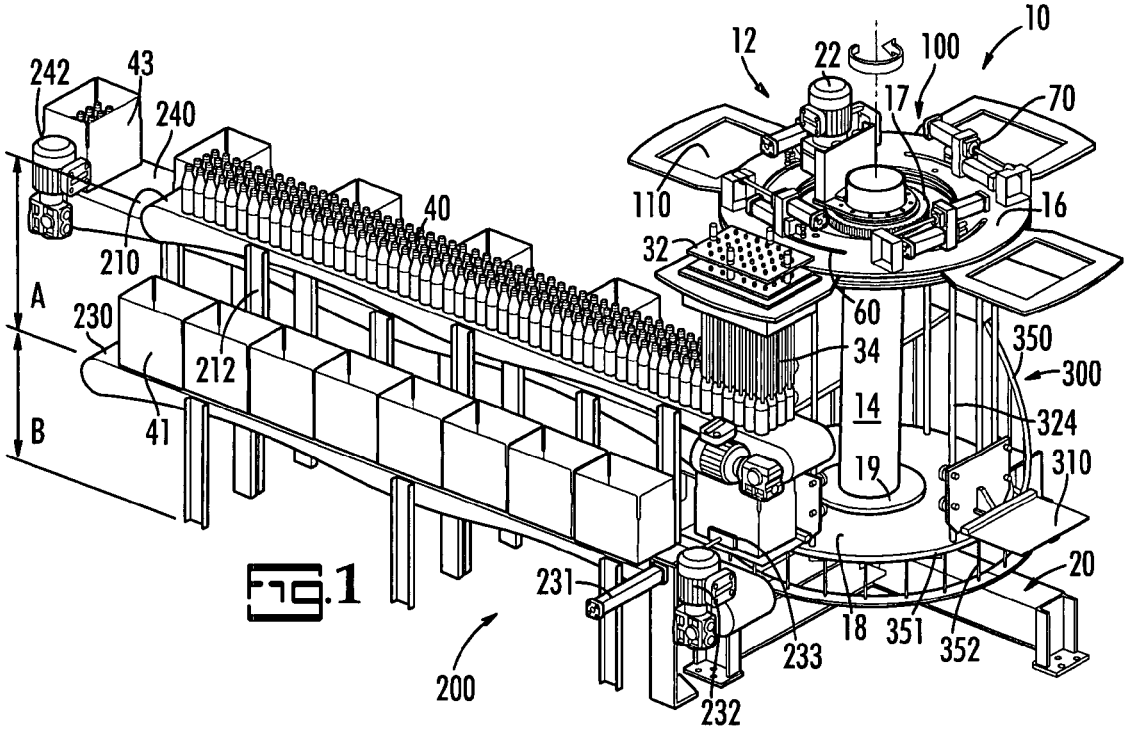
FIG. 1 illustrates a perspective view of a packing system according to a preferred embodiment of the present invention.
Figure 2:
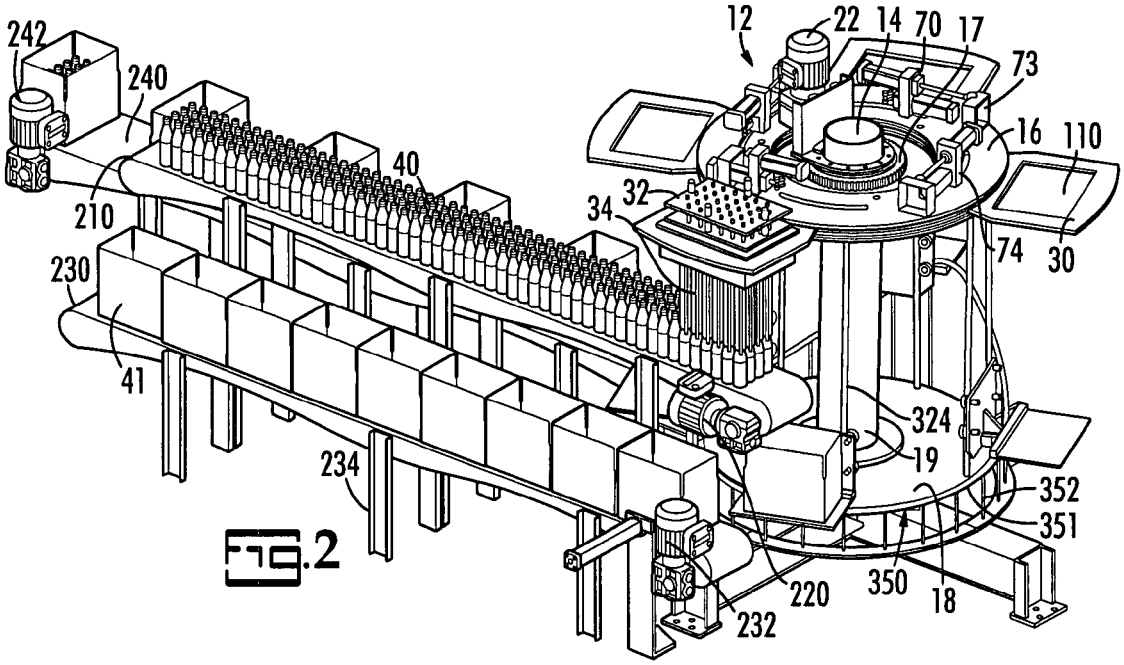
FIG. 2 illustrates a perspective view of a packing system according to a preferred embodiment of the present invention.
Figure 3:
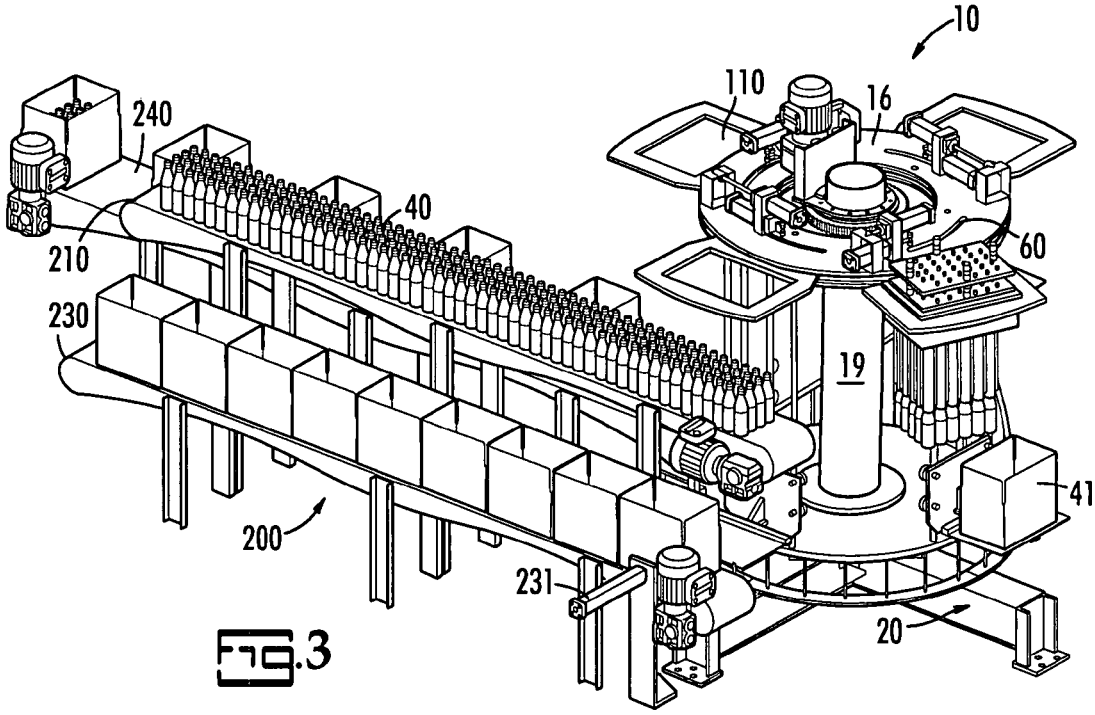
FIG. 3 illustrates a perspective view of a packing system according to a preferred embodiment of the present invention.
Figure 4:
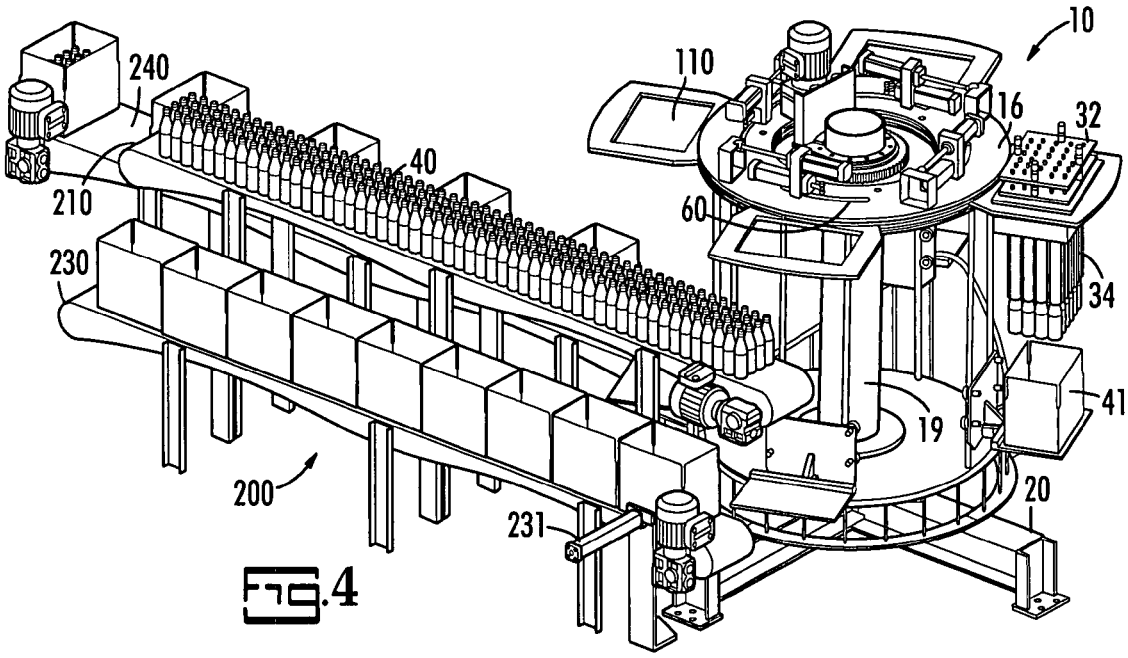
FIG. 4 illustrates a perspective view of a packing system according to a preferred embodiment of the present invention.
Figure 5:
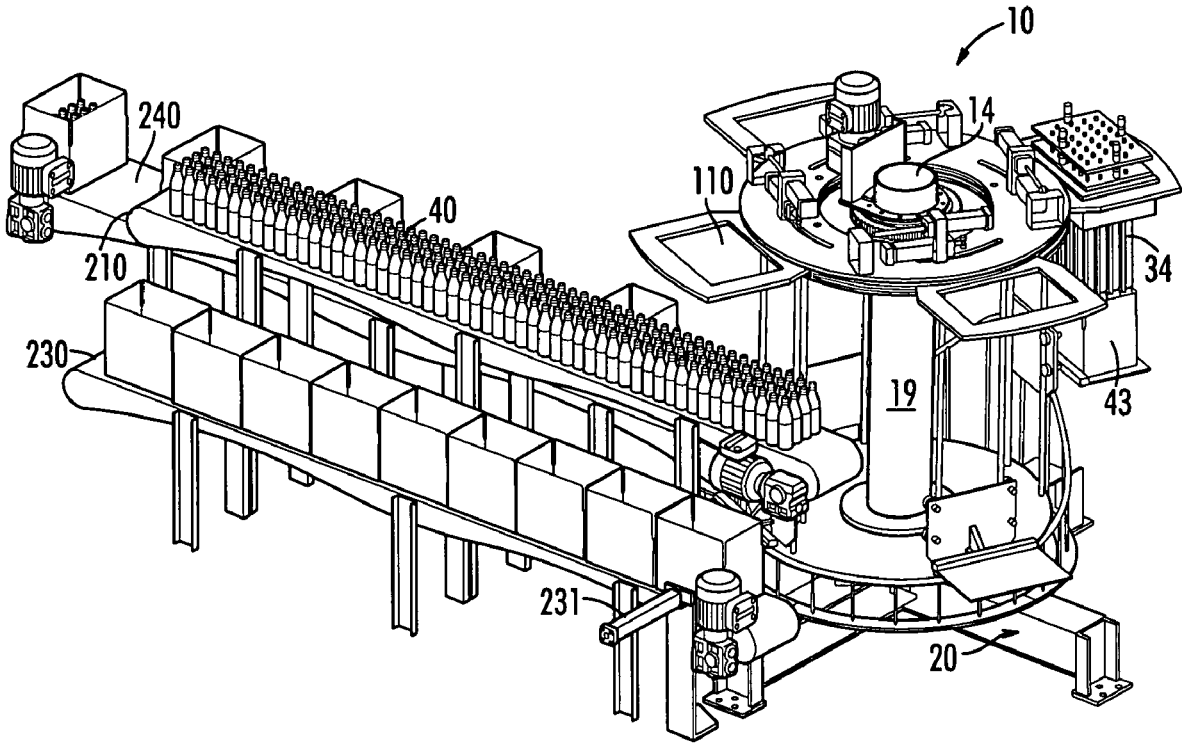
FIG. 5 illustrates a perspective view of a packing system according to a preferred embodiment of the present invention.

As illustrated in the figures, the present invention includes a circular motion packing system 10 and method for simulating the continuous packing of containers with objects. FIGS. 1-11 show perspective views of the packing system 10 at various stages of the packing process. The packing system generally includes a circular motion packing apparatus 100 that is operatively connected to a conveyor apparatus 200 and an escalator carrier apparatus 300. The present system can be operated through a variety of automated and/or computerized means.

Preferably, the circular motion packing apparatus 100 includes a rotating means 12 that is floor mounted by a frame 20. The rotating means 12 includes a central column 14 supporting an upper disc 16 and a lower disc 18 through a geared bearing 17 and a radial bearing 19, respectively. Multiple arms 30 extend from and are supported by the upper disc 16. Each of these arms 30 is dimensioned to carry a mechanical packing head 32, which includes a plurality of grippers 34 for engaging and transporting objects or articles of interest. Although a variety of types and sizes of objects can be packed into containers by the packing system 10 of the present invention, for exemplary purposes only, the objects shown in the figures are bottles 40.

Figure 12:
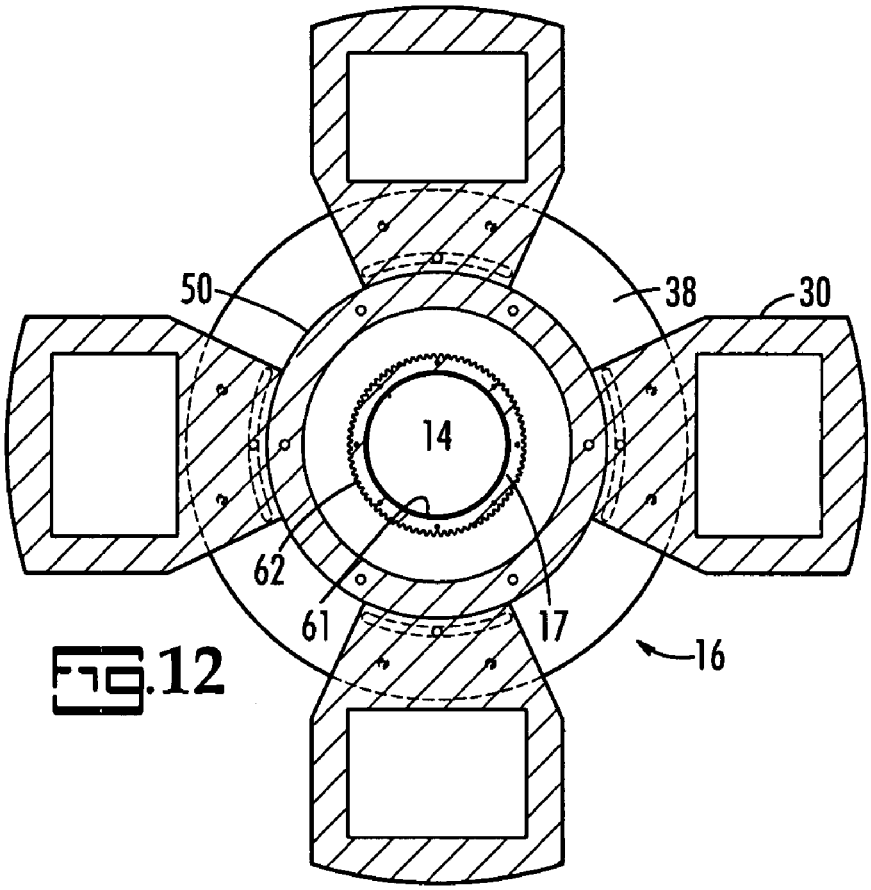
FIG. 12 illustrates a top plan view illustrating parts of an upper disc assembly of a packing apparatus according to a preferred embodiment of the present invention.
Figure 13A:
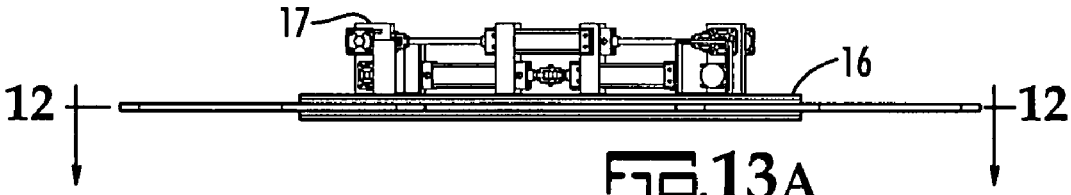
FIG. 13A is a side elevation illustrating parts of an arm motion mechanism for controlling the circular motion of the arms of a packing apparatus according to a preferred embodiment of the present invention.
Figure 13B:
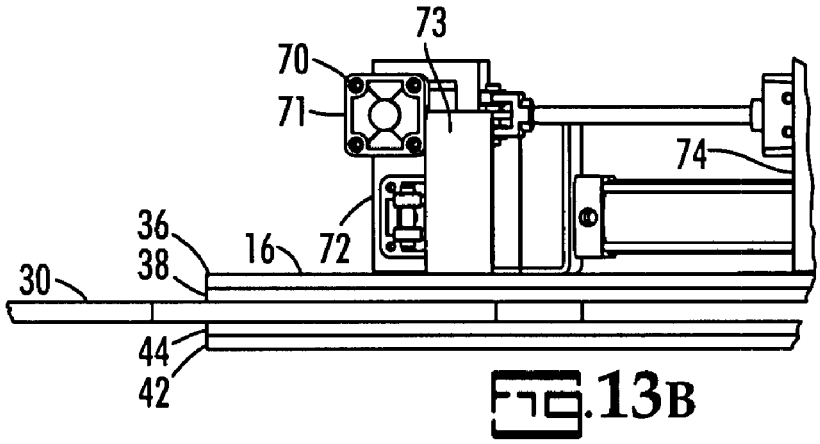
FIG. 13B is a side elevation illustrating parts of an arm motion mechanism for controlling the circular motion of the arms of a packing apparatus according to a preferred embodiment of the present invention.
Figure 14A:
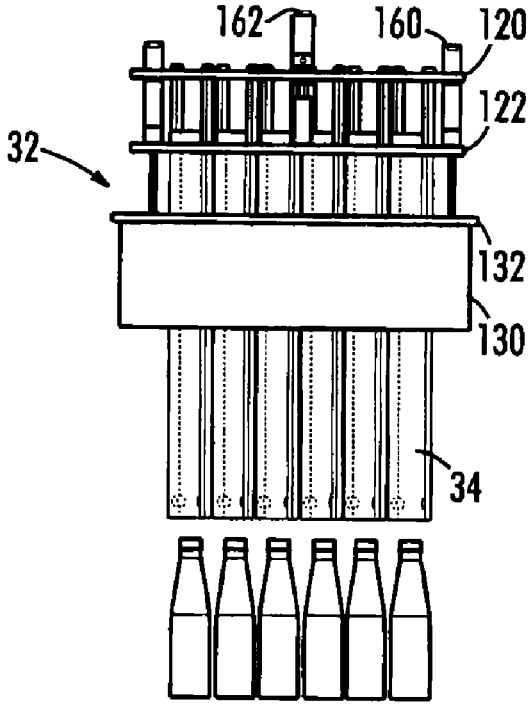
FIG. 14A is a side elevation illustrating a mechanical packing head having a plurality of grippers shown in retracted and released position with a plurality of articles according to a preferred embodiment of the present invention.
Figure 14B:
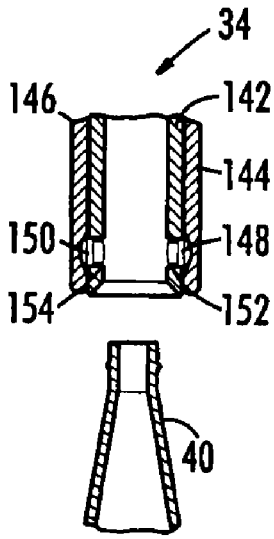
FIG. 14B is a side elevation illustrating the parts of a gripper that is shown in retracted and released position with an article according to a preferred embodiment of the present invention.
Figure 15A:
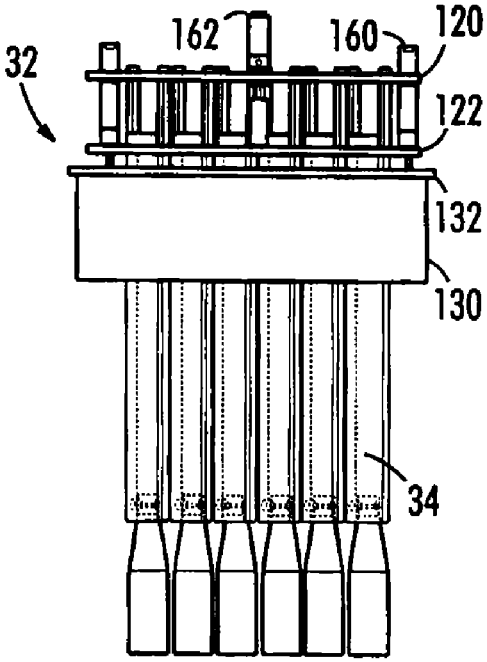
FIG. 15A is a side elevation illustrating a mechanical packing head having a plurality of grippers shown in a extended and released position with a plurality of articles according to a preferred embodiment of the present invention.
Figure 15B:
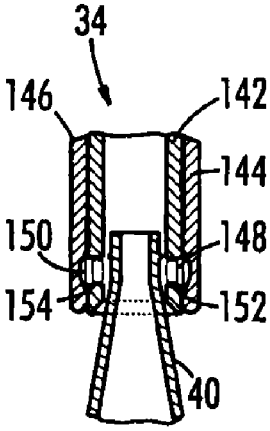
FIG. 15B is a side elevation illustrating the parts of a gripper that is shown in extended and released position with an article according to a preferred embodiment of the present invention.
Figure 16A:
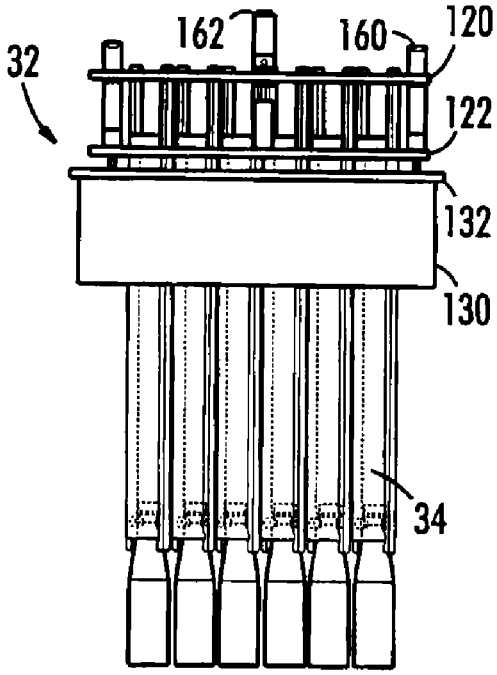
FIG. 16A is a side elevation illustrating a mechanical packing head having a plurality of grippers shown in extended and gripping position with a plurality of articles according to a preferred embodiment of the present invention.
Figure 16B:
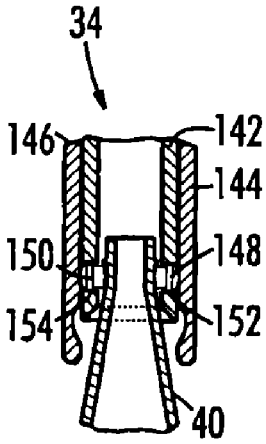
FIG. 16B is a side elevation illustrating the parts of a gripper shown in extended and gripping position with an article according to a preferred embodiment of the present invention.

FIGS. 12-13B illustrate the upper disc 16 assembly in more detail. The upper disc 16 revolves around the vertical center axis of the column 14 in a horizontal, circular path and at a continuous angular velocity. The driving of the upper disc 16 is preferably done by an electric motor and gear reducer 22, and a pinion 24 (shown in FIG. 7) that engages the geared bearing 17. As shown, the upper disc 16 can include a number of discs and plates to facilitate both continuous and intermittent circular motion. Preferably, the upper disc 16 includes a top disc 36 above a first wear plate 38 and a bottom disc 42 below a second wear plate 44. Between the first and second wear plates 38, 44 is included a center guide disc 50 that is in juxtaposed relation to the arms 30. In particular, the arms 30 are not connected to the center guide disc 50. Rather, the outside diameter of the center guide 50, which can be in the shape of a ring, provides a diameter around which the inside diameter of the arms 30 rotate. However, the top and bottom discs 36, 42, first and second wear plates 38, 44, and center guide disc 50 are operatively connected. This arrangement allows for the arms 30 to be free from clamping and independent from the rotating upper disc 16. Additionally, through the top disc 36 and the first wear plate are slots 60 (shown in FIGS. 1-11) that are dimensioned to limit the angular movement of the arms 30. These slots 60 are preferably curved so as to allow horizontal, circular movement complementary to that of the upper disc 16. Furthermore, the slots 60 can prevent a collision between the arms 30 as they are being independently advanced and retarded.

As further shown, the stationary inner ring 61 of the geared bearing 17 is mounted to the center column 14 and the live outer ring 62 of the geared bearing 17 is operatively connected to the upper disc 16 assembly. In operation, the pinion 24, driven by the motor-gear reducer 22, in turn drives the outer ring 62 of the geared bearing 17 thereby rotating the upper disc 16 and the arms 30. The arrangement of the upper disc 16, however, provides the arms 30 the ability to freely and separately revolve around the center axis of the column 14 while they are also revolving with the upper disc 16. This arm movement can be at variable speeds relative to the constant speed of the upper disc 16.

Whereas the top and bottom discs 36, 42; first and second wear plates 38, 44, and center guide disc 50 continuously rotate at a constant angular velocity, the velocity of each of the arms 30 can be accelerated and decelerated as the arms 30 are not operatively connected to the geared bearing 17. Instead, the arms 30 are connected to an arm movement mechanism 70. Accordingly, the geared bearing 17 with the motor-reducer 22 can be considered a primary drive of the disc assembly, whereas the arm movement mechanism 70 can be considered a secondary drive. Preferably, the arm movement mechanism 70 includes a pair of cylinders 71, 72 connected to each of multiple arms 30. Most preferably, these cylinders 71, 72 are pneumatically operated. In particular, an upper cylinder 71 and a lower cylinder 72 can be mounted to the upper disc 16 and connected to the arms 30. For example, a bracket 73 can be used to connect the upper cylinder 71 to the upper disc 16. Each pair of cylinders is preferably bolted together so that the cylinders operate linearly to one another. A connecting block 74 can be used to connect the upper and lower cylinders 71, 72 to each other. Lastly, any number of mechanical connecting means can be used to connect the cylinders 71, 72 through the slots 60 to the arms 30. For example, the rod clevis 63 of lower cylinder 72 can be connected to the arms 30 through bolting (not shown). Depending on the particular mounting and connectors used, the upper cylinder 71 can be used to move the arm 30 from a neutral to a retarded position and then back to a neutral position. Similarly, the lower cylinder 72 can be used to move the arm 30 from a neutral to an advanced position and then back to a neutral position.

A feature of the present invention includes the use of a continuously rotating disc 16 in combination with arms 30 that can be advanced and retarded intermittently so as to simulate continuous motion packing without having to include the structural features and complications of a packing apparatus having continuously moving mechanical packing heads. Because the arm movement mechanism 70 is connected to the upper disc 16, the arms 30 can both move continuously with the disc 16, or they can be advanced and retarded by the arm movement mechanism 70 separately from the movement of the disc 16.

As discussed, the packing apparatus 100 further includes a mechanical packing head 32 that is mounted to each of the multiple arms 30. The features of a preferred mechanical packing head 32 are shown in further detail in FIGS. 14A-16B. As shown, the mechanical packing head 32 includes an upper plate 120, a lower plate 122, a base 130, and a plurality of grippers 34. Base 130 can also include a flange 132 that serves to support the mechanical packing head 32 when it is engaged with the arms 30. In particular, each arm 30 can include an aperture 110 dimensioned to receive the base 130 of mechanical packing head 32. Accordingly, the flange 132 of the base 130 can rest along the edges of the aperture 110. Each of the mechanical grippers 34 includes a tube 142, a first and second external cam 144, 146, and a first and second spring-loaded plug 148, 150. The use of external cams, and especially cam 144, can help reduce the cost of making the assembly. Preferably, the tube 142 of each gripper 34 is mounted to the lower plate 122 of the mechanical packing head 32. Each tube 142 extends downward through apertures (not shown) in the base 130 that locates and guides the tube 142. Each of first and second cam 144, 146 is mounted to the upper plate 120 and also extends downward through the apertures of the base 130 that locate and guide the cams. The spring-loaded plugs 148, 150 are preferably mounted in a first and second opening 152, 154, respectively, of tube 142, and are spring-loaded against the first and second cam 144, 146, respectively.

Although a variety of mechanical and electrical means can be employed to operate the mechanical packing head 32 and grippers 140, preferably, the mechanical packing head 32 is operated pneumatically. In particular, the mechanical packing head 32 can include an upper plate pneumatic cylinder 162 and a lower plate pneumatic cylinder 160. The individual pneumatic vertical movement of the upper and lower plates 120, 122, and subsequently the tube 140 and cams 144, 146 causes the plugs 148, 150 to move horizontally towards the center axis of the tube 140 gripping the article 40 to later be packed in containers. Although described in connection with the packing system 200, conveyor system 200, and escalator carrier system 300, the mechanical packing head 32 of the present invention can also be employed with other apparatuses not described needing the gripping and packing of articles.

The conveyor apparatus 200 and escalator carrier apparatus 300 are also important features in the packing system 10 of the present invention. As illustrated in FIGS. 1-11, the conveyor apparatus 200 preferably includes multiple conveyors, and most preferably three conveyors. A first conveyor, referred to herein as an article conveyor 210, can be operated by electric motor 220 and floor-mounted through article conveyor supports 212 so that article conveyor 210 is at an elevation A relative to the floor. As shown, article conveyor 210 is utilized to carry and transport articles, such as the bottles 40 shown, towards the rotating disc 16.

A second conveyor, referred to herein as a container conveyor 230, can also be operated by electric motor 232 and floor-mounted through container conveyor supports 234 so that container conveyor 230 is at an elevation B relative to the floor. The container conveyor 230 transports empty containers 41 towards the rotating disc 16. Preferably, elevation A of the article conveyor 210 is higher than elevation B of the container conveyor 230.

Lastly, a third conveyor, referred to herein as a packed container conveyor 240, can also be operated by electric motor 242 and floor-mounted through packed container conveyor supports 244 so that packed container conveyor 240 is at an elevation C relative to the floor. The packed container conveyor 240 transports containers packed with articles 43 away from the rotating disc 16. Preferably, elevation C of the packed container conveyor 240 is about equal to or lower than elevation B of the container conveyor 230.

Figure 17:
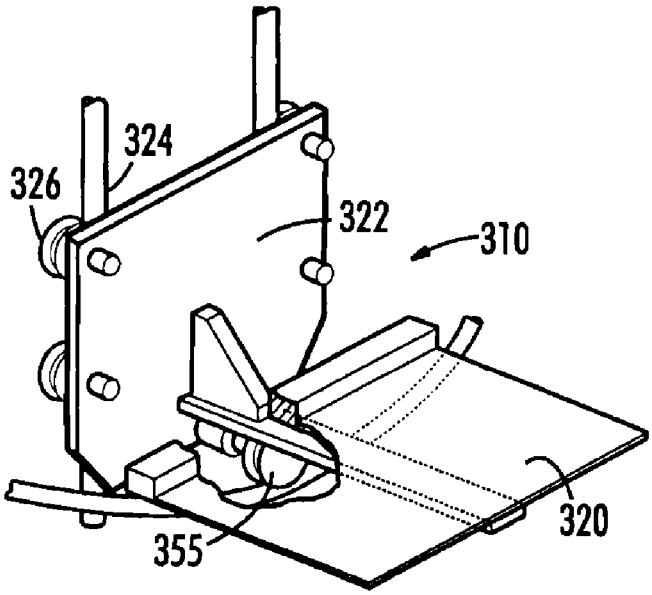
FIG. 17 is a perspective, cutaway view illustrating parts of an escalator carrier mechanism of a packing system according to a preferred embodiment of the present invention.
Figure 18:
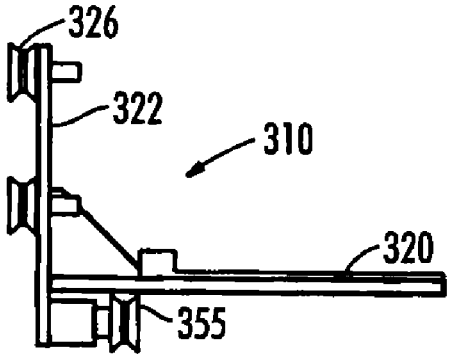
FIG. 18 is a side elevation illustration parts of an escalator carrier mechanism of a packing system according to a preferred embodiment of the present invention.

The conveyor apparatus 200 is operatively connected to the escalator carrier apparatus 300. As illustrated, the escalator carrier apparatus 300 includes a plurality of escalator carriers 310. Preferably, there is one escalator carrier 310 per arm 30. In the exemplary embodiment, the packing system 10 includes four arms 30 and four escalator carriers 310. The escalator carriers 310 are connected to packing apparatus 100 through a number of guides. These carriers 310 are shown in detail in FIGS. 17-18. As illustrated, each escalator carrier 310 includes a platform 320 dimensioned to support an empty container 41 and a connecting plate 322. The connecting plate 322 includes a series of cam followers that engage guides along the packing apparatus 100.

FIGS. 1-11 illustrate these guides. Multiple rods 324 extend downward from the upper disc 16. These rods 324 serve as a vertical guide for engaging vertical cam followers 326 of escalator carrier 310. Furthermore, the multiple rods 324 support and cause to revolve together with the upper disc 16 the second, lower disc 18, previously described. The lower disc 18 is centered on the column 14 by the radial bearing 19. Also shown in FIGS. 1-11 is a concentric guide 350 that surrounds the lower disc 18. A guide frame 352 supports the stationary, endless, guide rail 351 concentric to the center axis of the column 14. In particular, the guide rail 351 is a continuous track, such as oval, egg-shaped, or the like, with changes in elevation as it circumvents the column 14. This concentric guide 350 engages the concentric cam follower 355 of escalator carrier 310. Thus, escalator carrier 310 revolves around the center axis of the column 14 along a horizontal and vertical and circular path. The path of escalator carrier 310 is therefore both convergent and divergent to the path of the upper disc 16. Although the escalator carrier system 300 is described in connection with the packing system 100 and the conveyor 200, the escalator carrier system 300 can be employed on other apparatuses requiring the carrying of objects to varying elevations.

Figure 6:
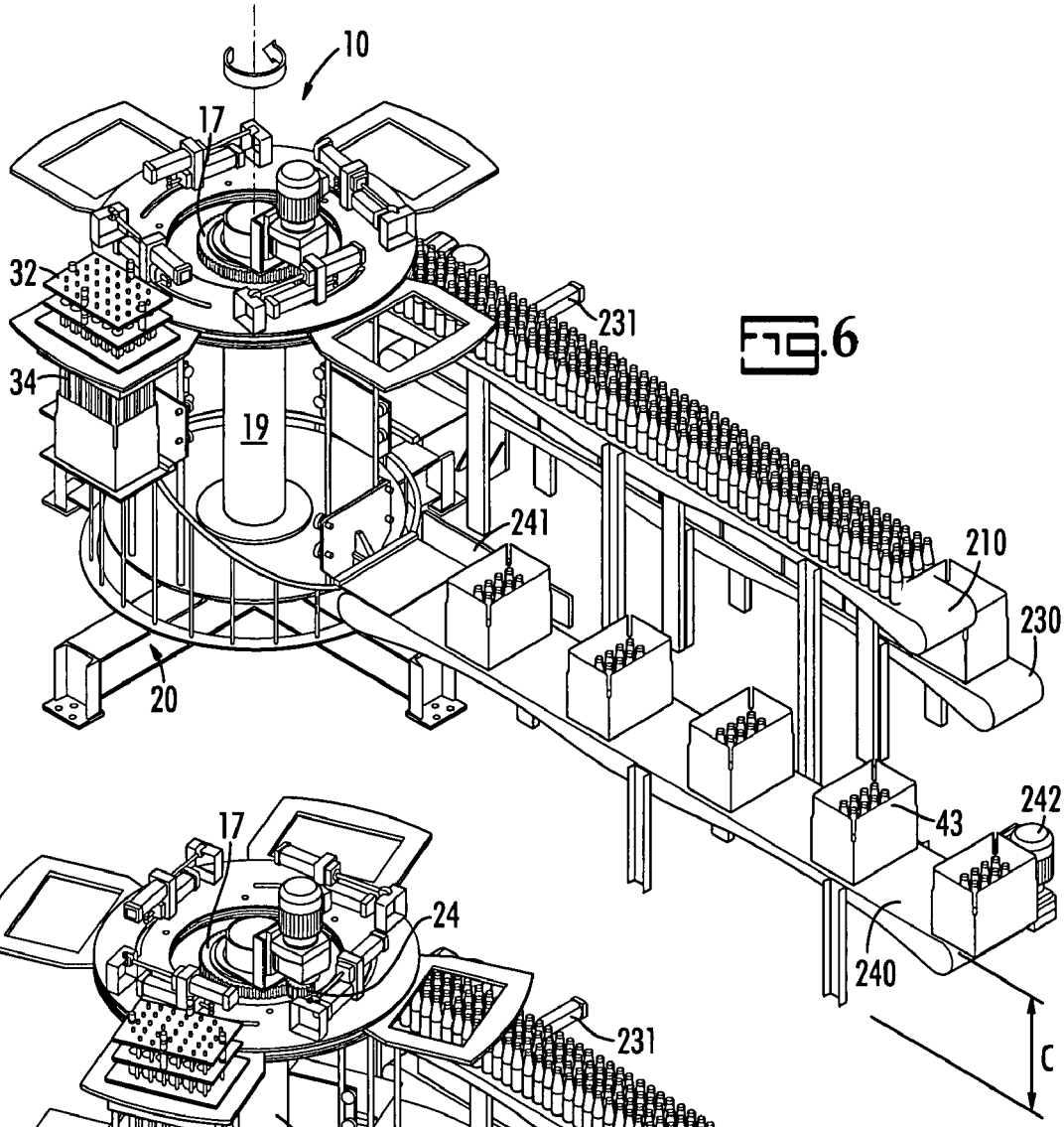
FIG. 6 illustrates a perspective view of a packing system according to a preferred embodiment of the present invention.
Figure 7:
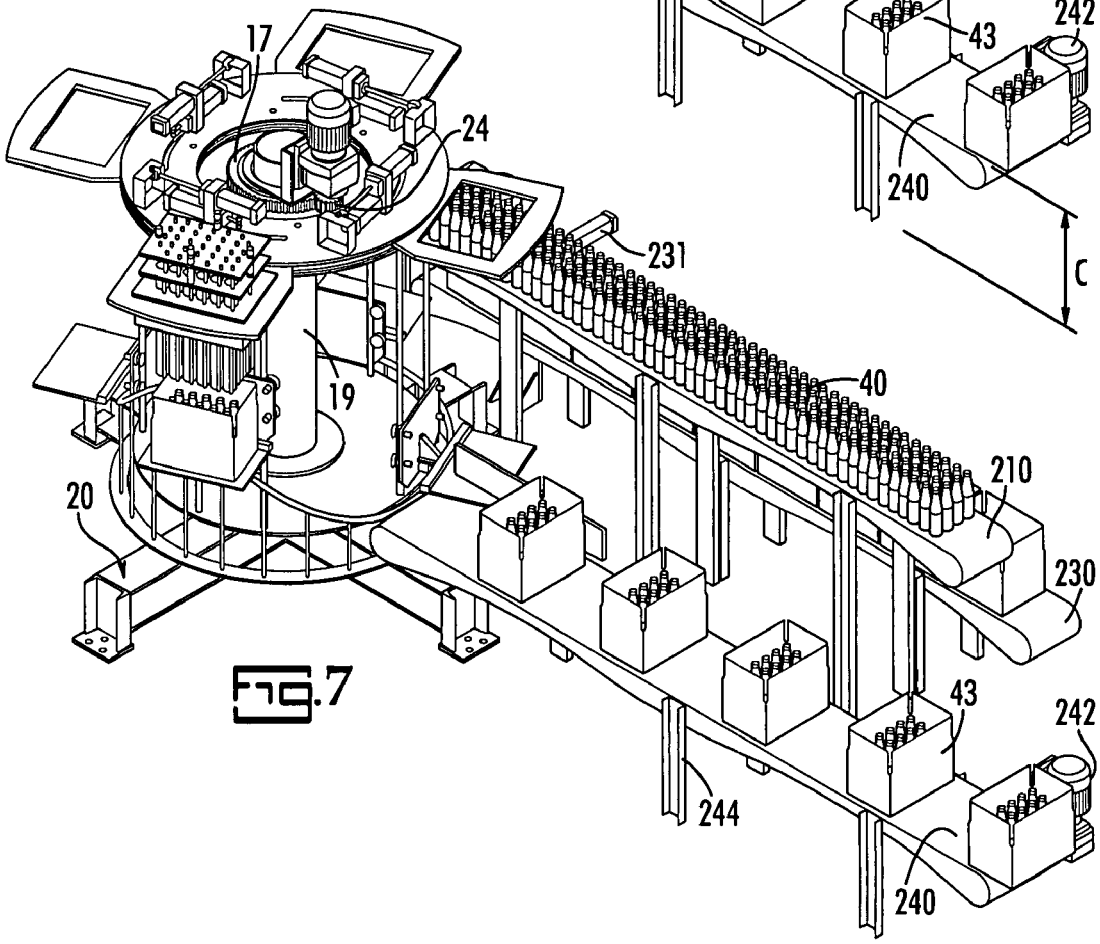
FIG. 7 illustrates a perspective view of a packing system according to a preferred embodiment of the present invention.
Figure 8:
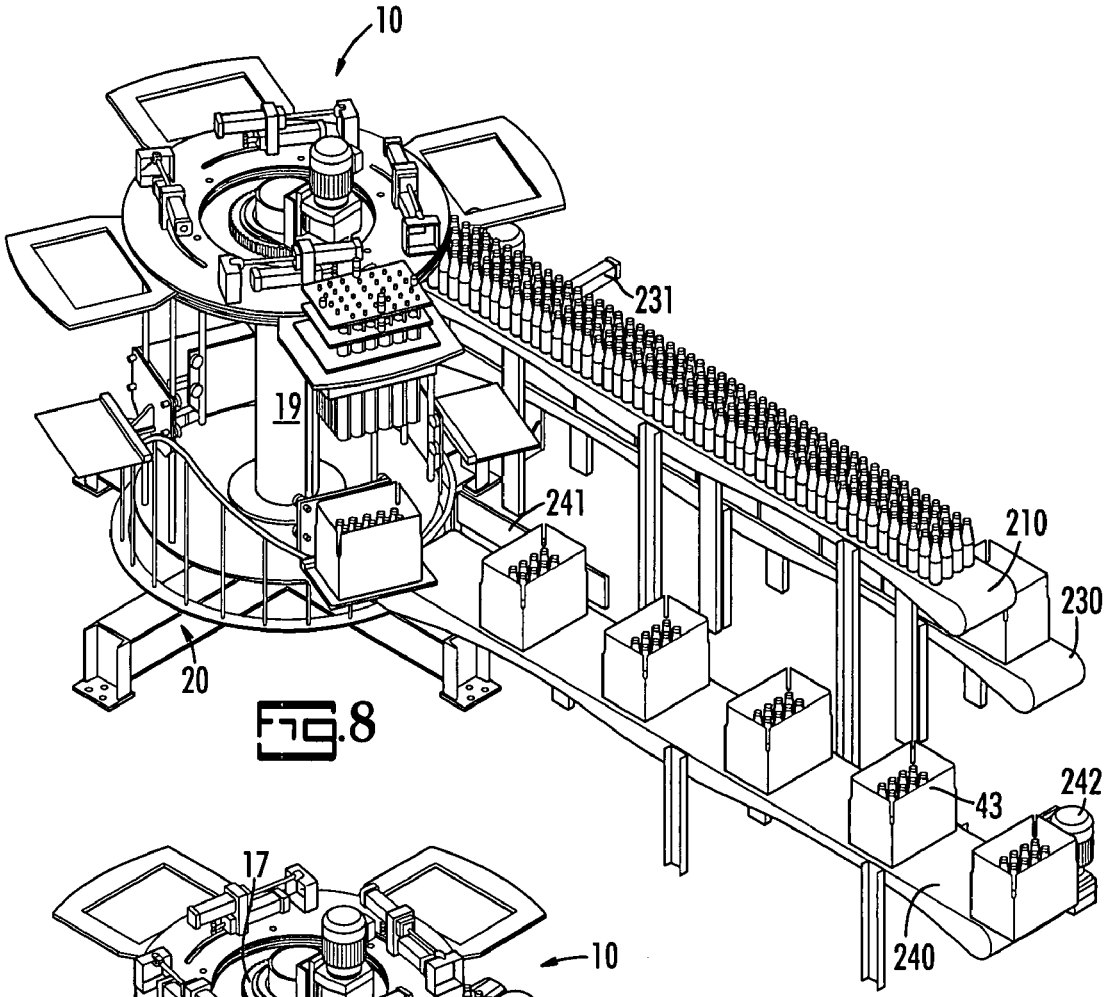
FIG. 8 illustrates a perspective view of a packing system according to a preferred embodiment of the present invention.
Figure 9:
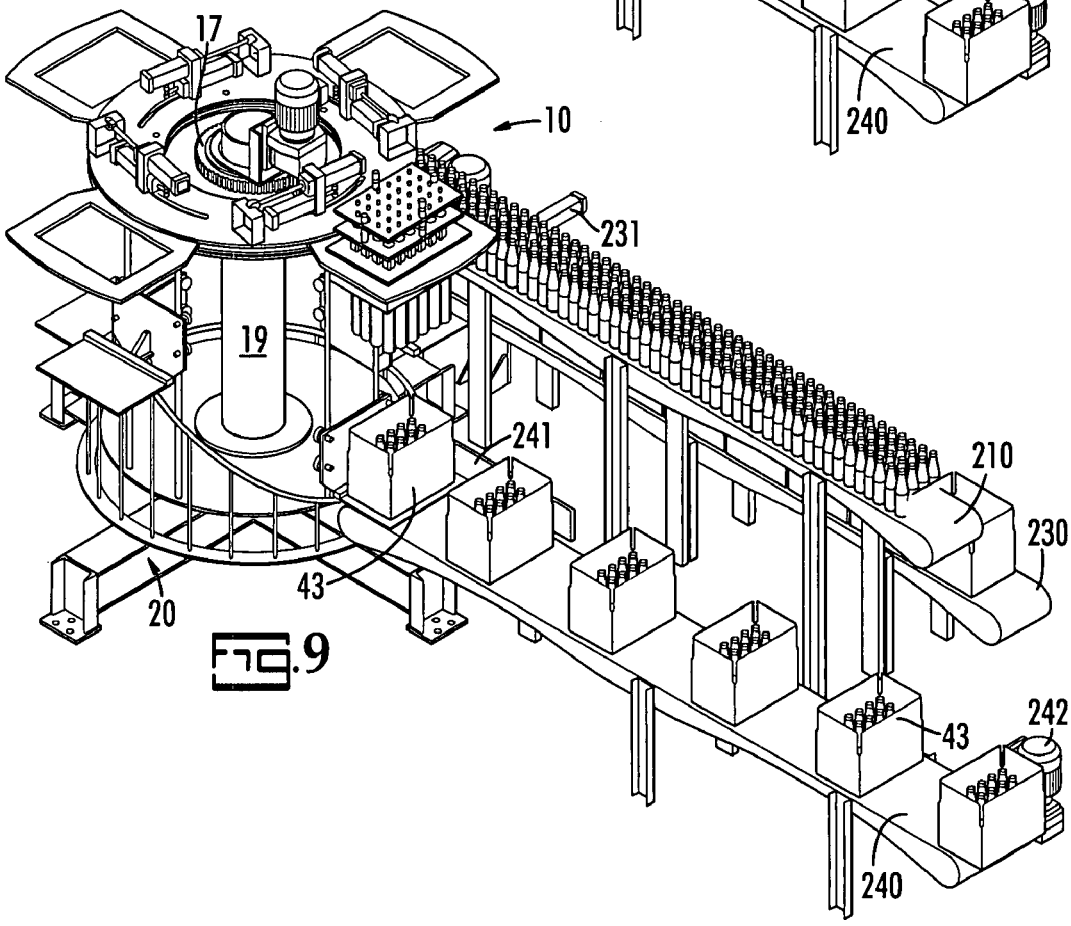
FIG. 9 illustrates a perspective view of a packing system according to a preferred embodiment of the present invention.
Figure 10:
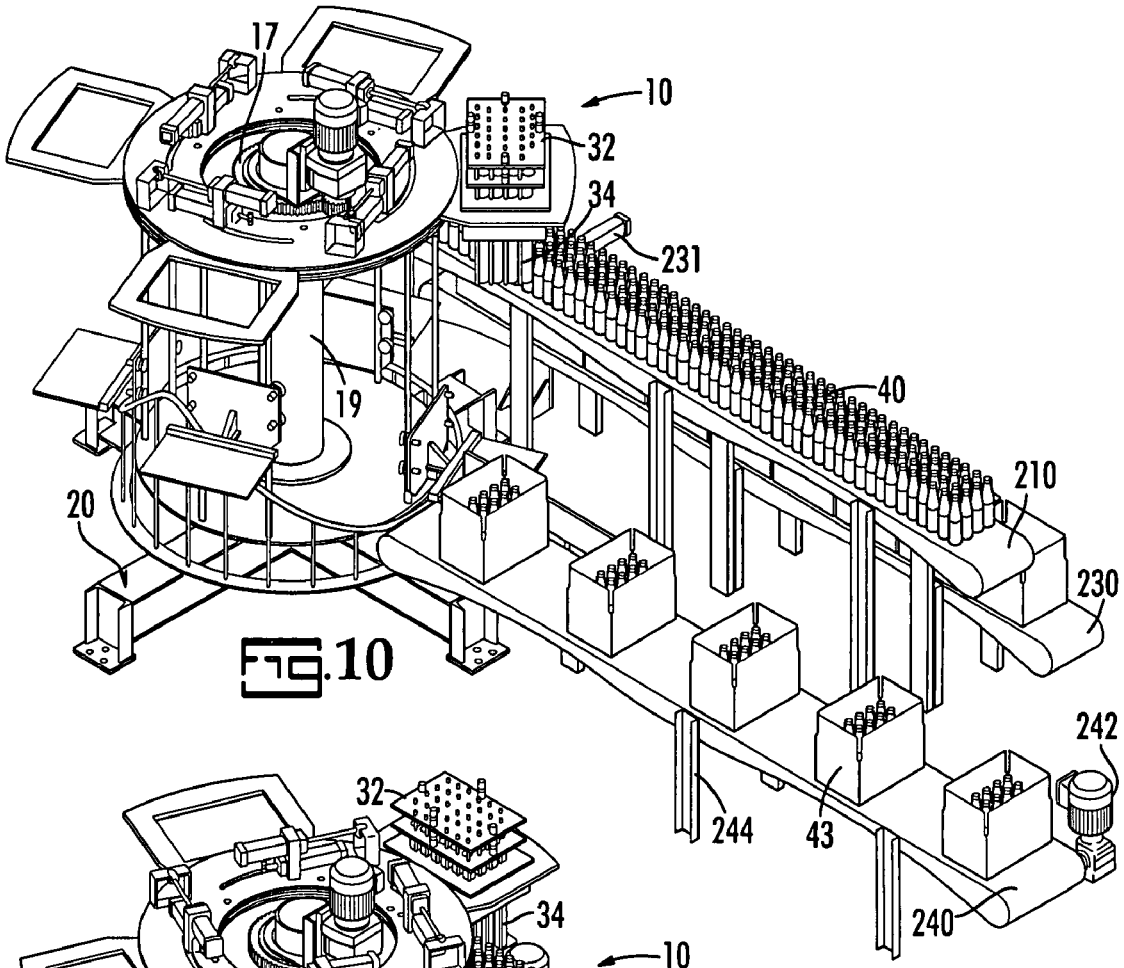
FIG. 10 illustrates a perspective view of a packing system according to a preferred embodiment of the present invention.
Figure 11:
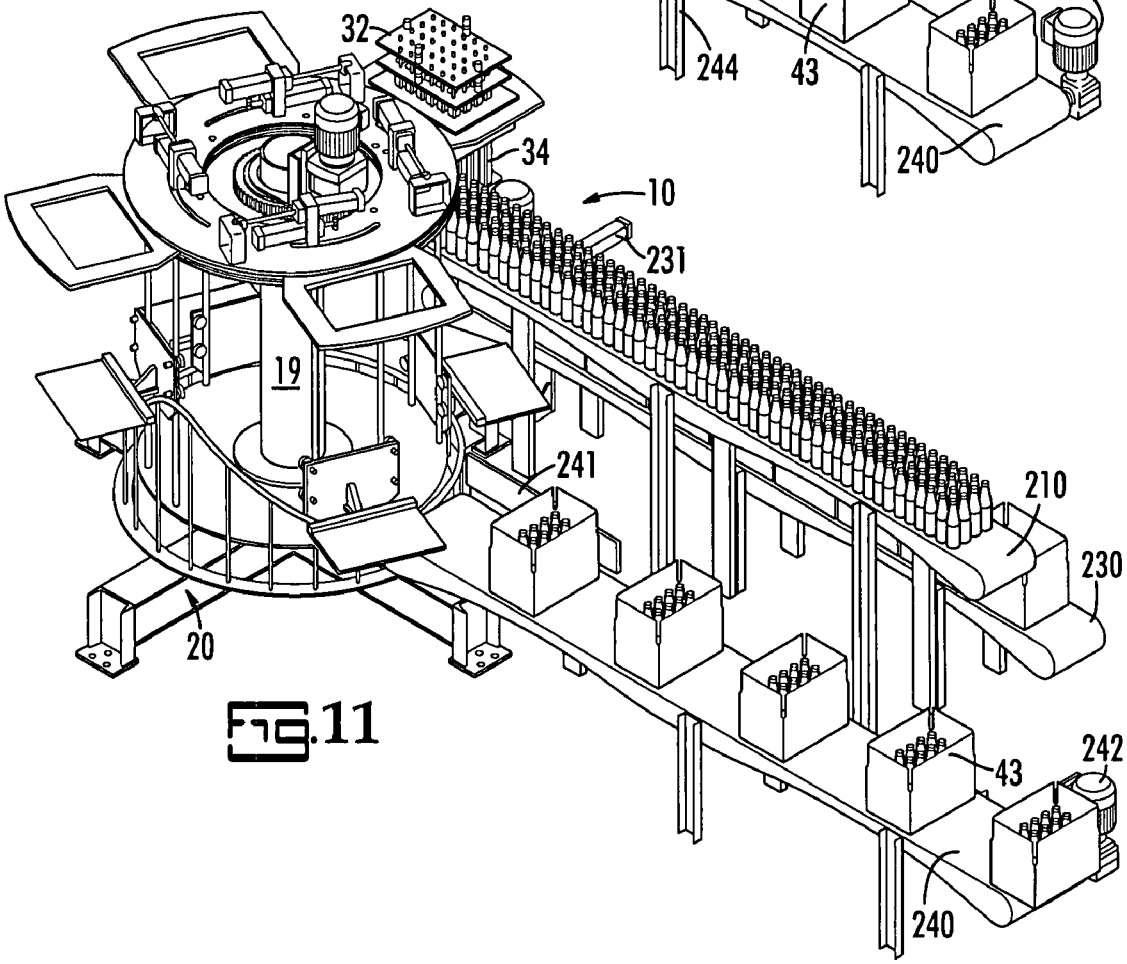
FIG. 11 illustrates a perspective view of a packing system according to a preferred embodiment of the present invention.

To facilitate the placement of empty containers 41 on the escalator carrier platforms 320, a container loading device 231 that is operatively connected to container conveyor 230. Preferably, the container loading device 231 includes a press 233 that is pneumatically operated to extend and push an empty container 41 onto the platform 320 of escalator carrier 310. Similarly, and as shown in FIGS. 6-7, the packed container conveyor 240 includes a container unloading device. In particular, the container unloading device includes a guide rail 241 that is mounted at an elevation above the surface of the packed container conveyor 240 and below the top edge of the packed containers 43. As illustrated, the guide rail 241 is dimensioned and positioned so that a packed container 43 is stopped or prevented from proceeding further along the continuous path of the escalator carrier 310. However, there is a gap between the guide rail 241 and the packed container conveyor 240 sufficient to allow the escalator carrier 241 to move through and continue along its path.

The following describes the method of the present invention according to a preferred embodiment. Articles such as bottles 40 are provided and transported by article conveyor 210 towards packing apparatus 100 at an elevation A. As discussed, each arm 30 of the upper disc 16 includes mechanical packing head 32. When a first set of bottles 40 arrives at the end of article conveyor 210 closest to upper disc 16, one of the mechanical packing heads 32 is moved to an advanced position by the corresponding arm 30. Because the upper disc 16 is continuously rotated at a constant speed, this advancement step requires the velocity of the corresponding arm 30 to be accelerated relative to the velocity of the upper disc 16. This advancement is done so that there is sufficient time for the mechanical packing head 32 to be positioned in sufficient proximity to be able to pick up or retrieve the first articles in line along the article conveyor 210 without the need to stop the rotation of the packing apparatus 100.

During the retrieval of the articles by the head 32, the head 32 is moved by the corresponding arm 30 to a neutral and then retarded position. Effectively, these moving steps are timed so that the position of the head 32 remains stationary while the product or article is being picked up by the grippers 34. In order to simulate a stop, the velocity of the corresponding arm 30 is about equal to the velocity of the upper disc 16, but in the opposite direction of the movement of upper disc 16. This step allows the velocity of the head 32 to be about zero relative to the point where the first set of articles is located. Once the mechanical packing head 32 has effectively engaged these articles, this mechanical packing head 32, now carrying the articles, can be returned once again to a neutral position by the corresponding arm 30 so that it continues to move with, and not ahead of, the rotating disc 16. This step will require that the velocity of the arm 30 is accelerated relative to the constant velocity of the disc 16.

Simultaneous with the transporting of articles by the article conveyor 210, empty containers 41 are provided and transported towards packing apparatus 100 at elevation B by container conveyor 230. Once the mechanical packing head 32 is moved back to a neutral position upon retrieving the articles, an empty container 43 is pushed onto escalator carrier 310. At a neutral position, the head 32 carrying the articles is over the empty container 43. Both the head 32 and the empty container 43 revolve around the center column 14 at a constant speed. Resting on the escalator carrier 310, the empty container 43 is accordingly moved along the path of the concentric guide 350. As the empty container 43 revolves around the center axis of the column 14, it is raised to an elevation approaching elevation A, shown in FIG. 6, which allows the articles carried by the head 32 to be conveniently released into the empty container 43.

Once the articles have been released by the mechanical packing head 32, the corresponding arm 30 can be once again moved to an advanced position to repeat the cycle. The escalator carrier 310 meanwhile is lowered to an elevation approaching elevation C that allows the packed containers 43 to be placed onto the packed container conveyor 240, which transports the packed containers 43 away from the packing apparatus at elevation C. The escalator carrier 310 being relieved of the packed container 43 is then moved along the concentric guide 350 to a position juxtaposed to conveyor loading mechanism 231 and to an elevation approaching elevation B so that the cycle can repeat.

Those skilled in the art of circular motion packing systems will recognize that many substitutions and modifications can be made in the forgoing preferred embodiments without departing from the spirit and scope of the present invention.

What is claimed is:

1. An apparatus for packing containers, comprising:

an upper disc surrounding a center column and having a plurality of arms, wherein said upper disc rotates around said center column through a primary drive at a constant speed, and wherein each of said plurality of arms rotates around said center column at a variable speed relative to said constant speed;

a packing head connected to each of said plurality of arms;

a conveyor system operatively connected to said upper disc, wherein said conveyor system comprises an article conveyor having a first elevation, a container conveyor having a second elevation and a packed container conveyor having a third elevation; and an escalator carrier system that is operatively connected to said upper disc, wherein said escalator carrier system includes an escalator carrier for each of said plurality of arms.

2. The apparatus as recited in claim 1, wherein said upper disc includes a top disc, a bottom disc and a center guide, and wherein said plurality of arms are in juxtaposed relation to said center guide.

3. The apparatus as recited in claim 2, wherein said top disc includes a plurality of slots, wherein each of said plurality of slots is over one of said plurality of arms.

4. The apparatus as recited in claim 3, further comprising a secondary drive connected to said top disc and to each of said plurality of arms through said plurality of slots, respectively.

5. The apparatus as recited in claim 4, wherein said secondary drive is a pair of pneumatic cylinders for each of said plurality of arms, wherein said pair of pneumatic cylinders are connected to each other so as to achieve linear movement with relation to each other.

6. The apparatus as recited in claim 5, wherein said pair of pneumatic cylinders includes an upper cylinder and a lower cylinder, and wherein said upper cylinder moves each of said plurality of arms, respectively, from a first position relative to the length of said one of said plurality of slots to a second position relative to the length of one of said plurality of slots and back to said first position, and wherein said second position is retarded from said first position.

7. The apparatus as recited in claim 6, wherein said lower cylinder moves each of said plurality of arms, respectively from said first position to a third position relative to the length of said one of said plurality of slots and back to said first position, and wherein said third position is advanced from said first position.

8. The apparatus as recited in claim 1, wherein said primary drive includes an electric motor and gear reducer operatively connected to a pinion that is operatively connected to a geared bearing, and wherein said geared bearing is mounted to said center column.

9. The apparatus as recited in claim 1, wherein said packing head includes an upper plate, a lower plate, a base, and a plurality of grippers.

10. The apparatus as recited in claim 9, wherein each of said plurality of arms includes an aperture, wherein said base includes a flange, and wherein said aperture is dimensioned to receive and engage said flange.

11. The apparatus as recited in claim 9, wherein each of said plurality of grippers includes a tube, a first and second external cam, and a first and second spring-loaded plug.

12. The apparatus as recited in claim 11, wherein said tube is between said first and second external cams, and wherein said first and second spring-loaded plugs are mounted to said tube.

13. The apparatus as recited in claim 11, wherein said tube is mounted to said lower plate, and wherein each of said first and said second cams is mounted to said upper plate.

14. The apparatus as recited in claim 1, further comprising a lower disc connected to said upper disc by a plurality of vertical rods.

15. The apparatus as recited in claim 14, further comprising a guide surrounding said lower disc that is concentric to the center axis of said center column, wherein said guide is a continuous track having changes in elevation relative to said column.

16. The apparatus as recited in claim 15, wherein said escalator carrier moveably engages said plurality of vertical rods and said guide.

17. The apparatus as recited in claim 16, wherein said escalator carrier includes a platform and a carrier plate, wherein said carrier plate includes vertical cam followers for engaging said plurality of rods and a guide cam follower for engaging said guide.

18. The apparatus as recited in claim 1, further comprising a container loading device that is operatively connected to said container conveyor, wherein said container loading device includes a press for moving containers onto said escalator carrier.

19. The apparatus as recited in claim 1, further comprising a container unloading device including a guide rail that is mounted at an elevation above the surface of said packed container conveyor sufficient to allow said escalator carrier to pass between said guide rail and said packed container conveyor.

20. The apparatus as recited in claim 1, wherein said escalator carrier comprises:

a platform connected to a connecting plate, wherein said connecting plate has a vertical cam follower and a horizontal cam follower; and an escalator carrier guide that is a continuous track having changes in elevation wherein said horizontal cam follower is operatively connected to said escalator carrier guide.

21. The apparatus as recited in claim 1, wherein said packing head comprises:

an upper plate, a lower plate, a base, and a plurality of grippers, wherein each of said plurality of grippers includes a tube, a first and second external cam, and a first and second spring-loaded plug, wherein said tube is between said first and second external cams, and wherein said first and second spring-loaded plugs are mounted to said tube, and wherein said tube is mounted to said lower plate, and wherein each of said first and said second cams is mounted to said upper plate.

22. A method for packing containers, comprising:

providing an upper disc surrounding a center column and having an arm wherein said upper disc rotates around said center column through a primary drive at a constant speed and direction, and wherein said arm rotates around said center column at a variable speed and direction relative to said constant speed and direction of said upper disc;

providing a packing head connected to said arm;

providing a conveyor system operatively connected to said upper disc, wherein said conveyor system comprises an article conveyor having a first elevation, a container conveyor having a second elevation and a packed container conveyor having a third elevation;

providing an escalator carrier that is operatively connected to said upper disc, wherein said escalator carrier includes a guide surrounding said upper disc that is concentric to the center axis of said center column, wherein said guide is a continuous track having changes in elevation relative to said column;

providing an article for packing on said article conveyor;

moving said article conveyor so that said article approaches a point relative to said upper disc;

providing an empty container to said escalator carrier;

accelerating the speed of said arm relative to said constant velocity of said upper disc so that said one arm approaches said point;

reversing the direction of said arm relative to said constant direction of said upper disc;

decelerating the speed of said arm to about said constant speed of said upper disc;

retrieving said article by said packing head;

reversing the direction of said arm to the same direction as said constant direction of said upper disc;

accelerating the speed of said arm relative to said constant speed of said upper disc;

moving said escalator carrier along said guide so that said empty container approaches said retrieved article;

packing said empty container by said packing head.

* * * * *